US006002205A

United States Patent [19]

Mougin et al.

[11] Patent Number: 6,002,205

[45] Date of Patent: Dec. 14, 1999

[54] IMPLEMENTATION OF A FLAT DISPLAY SCREEN ANODE

[75] Inventors: Stephane Mougin, Castelnau le Lez; Guy Reynaud, Perols; Catherine Oules-Chaton, Theys, all of France

[73] Assignee: Pixtech SA, Rousset, France

[21] Appl. No.: 08/850,225

[22] Filed: May 2, 1997

[30] Foreign Application Priority Data

May 6, 1996 [FR] France ..... 96 05930

[51] Int. Cl.[6] ..... H01J 1/62

[52] U.S. Cl. ..... 313/496; 313/309; 313/336; 313/351; 313/495

[58] Field of Search ..... 313/309, 336, 313/351, 495, 496, 497, 966, 461, 477 R, 481

[56] References Cited

U.S. PATENT DOCUMENTS 5,534,749 7/1996 Ohoshi et al. ..... 313/497
5,543,691 8/1996 Palevsky et al. ..... 315/366

*Primary Examiner*—Nimeshkumar D. Patel
*Assistant Examiner*—Michael J. Smith
*Attorney, Agent, or Firm*—Arthur L. Plevy

[57] ABSTRACT

The present invention relates to a flat display screen anode of the type including at least two sets of alternate parallel bands of anode conductors coated with phosphor elements to be excited by primary electrons, these bands being separated from one another by insulating bands including, at least at the surface, a material with a secondary emission coefficient which is lower than or equal to unity, at least in the energy range of the primary electrons.

8 Claims, 2 Drawing Sheets

IMPLEMENTATION OF A FLAT DISPLAY SCREEN ANODE

BACKGROUND OF THE INVENTION

1. Field of the Invention

The present invention relates to flat display screens, and more particularly to so-called cathodoluminescence screens, the anode of which carries luminescent elements, separated from one another by insulating areas, and likely to be excited by electron bombarding. This electron bombarding requires the biasing of the luminescent elements and can come from microtips, from layers with a low extraction potential or from a thermo-ionic source.

2. Discussion of the Related Art

To simplify the present description, only color microtip screens will be considered hereafter, but it should be noted that the present invention generally relates to the various above-mentioned types of screens and the like.

FIG. 1 shows the structure of a flat color microtip display screen.

Such a microtip screen is essentially comprised of a cathode 1 having microtips 2 and of a grid 3 provided with holes 4 corresponding to the locations of microtips 2. Cathode 1 is placed facing a cathodoluminescent anode 5, a glass substrate 6 of which constitutes the screen surface.

The operating principle and a specific embodiment of a microtip screen are described, in particular, in U.S. Pat. No. 4,940,916 of the Commissariat à l'Energie Atomique.

Cathode 1 is organized in columns and is comprised, on a glass substrate 10, of cathode conductors organized in meshes from a conductive layer. The microtips 2 are implemented on a resistive layer 11 deposited on the cathode conductors and are arranged within the meshes defined by the cathode conductors. FIG. 1 partially shows the inside of a mesh and the cathode conductors do not appear on the drawing. Cathode 1 is associated with grid 3 organized in lines. The intersection of a line of grid 3 and of a column of cathode 1 defines a pixel.

This device uses the electric field which is created between cathode 1 and grid 3 to extract electrons from microtips 2. These electrons are then attracted by phosphor elements 7 of anode 5 if the latter are adequately biased. In the case of a color screen, anode 5 is provided with alternate bands of phosphor elements 7*r*, 7*g*, 7*b*, each corresponding to a color (Red, Green, Blue). The bands are parallel to the cathode columns and are separated from one another by an insulator 8, generally silicon oxide ($SiO_2$). The phosphor elements 7 are deposited on electrodes 9, comprised of corresponding bands of a transparent conductive layer such as indium and tin oxide (ITO). The sets of red, green, blue, bands are alternately biased with respect to cathode 1, so that electrons extracted from the microtips 2 of a pixel of the cathode/grid are alternately directed towards the phosphor elements 7 facing each of the colors.

The control for selecting the phosphor 7 (phosphor 7*g* in FIG. 1) which is to be bombarded by the electrons from the microtips of cathode 1 imposes to control, selectively, the biasing of phosphor elements 7 of anode 5, color per color.

Generally, the rows of grid 3 are sequentially biased at a potential of about 80 volts, while the bands of phosphor elements (for example 7*g* in FIG. 1) to be excited are biased under a voltage of about 400 volts via the ITO band on which the phosphor elements are deposited. The ITO bands, carrying the other bands of phosphor elements (for example, 7*r* and 7*b* in FIG. 1), are at a low or zero potential. The columns of cathode 1 are carried to respective potentials between a maximum emission potential and a no emission potential (for example, respectively 0 and 30 volts). The brightness of a color component of each of the pixels in a line is thus determined.

The choice of the values of the biasing potentials is linked with the features of phosphor elements 7 and of microtips 2. Conventionally, below a potential difference of 50 volts between the cathode and the grid, there is no electronic emission, and the maximum emission used corresponds to a potential difference of 80 volts.

A disadvantage of conventional screens is that they have a low lifetime, that is, after a relatively short operating time (of about one hundred hours), the brightness of the screen decreases significantly and destructive phenomena due to the forming of sparks between the screen cathode and anode may even sometimes be observed.

Further, after a certain operating time, the color appears to vary and no longer corresponds to the screen control settings. This phenomenon will be called herein "color shift". In practice, this means that at least one of the bands of phosphor material adjacent to the biased bands starts exhibiting a luminescence.

The origin of this phenomenon was not well understood up to now. It was thought to be due to the fact that electrons accumulate on the insulating areas 8 between the bands of phosphor material and ensure a conduction to neighboring bands. To avoid this phenomenon, several prior art techniques have been provided for, one of which consists in separating by short time intervals the biasings of the anode bands between two successive sub-color frames, and applying a negative voltage pulse on the band just biased, before positively biasing the next anode band to be excited.

However, this method has the disadvantage of being relatively complex to implement since it complicates the delivery of the anode supply voltages, which are voltages with high values (a few hundred volts) and it is prejudicial to the brightness of the screen.

SUMMARY OF THE INVENTION

The present invention aims at providing a new solution to the above-mentioned screen lifetime and color shift problems.

To achieve this object, the present invention provides a flat display screen anode of the type including at least two sets of alternate parallel bands of anode conductors coated with phosphor elements to be excited by primary electrons, these bands being separated from one another by insulating bands including, at least at the surface, a material having a secondary emission coefficient which is lower than or equal to unity, at least in the energy range of the primary electrons.

According to an embodiment of the present invention, the material has a maximum secondary emission coefficient which is lower than unity.

According to an embodiment of the present invention, the insulating bands are comprised of a single layer in a material having a secondary emission coefficient which is lower than unity and having sufficient resistivity to withstand a determined voltage difference between two neighboring bands of phosphor elements.

According to an embodiment of the present invention, the insulating bands are comprised of a first thin layer in an insulating material covered with a second very thin layer in a material having a secondary emission coefficient which is lower than unity.

According to an embodiment of the invention, the second layer has a width smaller than that of the first layer to leave, on either side of the second layer, an insulating space.

According to an embodiment of the present invention, the material constitutive of the second layer is chosen to have sufficient resistivity to withstand a determined voltage difference between two neighboring bands of phosphor elements.

According to an embodiment of the present invention, the second layer is in a conductive material, the thickness of the second layer being chosen to have sufficient resistance to withstand a determined voltage difference between two neighboring bands of phosphor elements.

According to an embodiment of the present invention, the material having a secondary emission coefficient lower than unity is selected among chromium oxide and iron oxide.

According to an embodiment of the present invention, the material constitutive of the second layer is graphite carbon.

According to an embodiment of the present invention, the insulating bands are in silicon oxide, the surface of which has been conditioned to develop a very thin layer of silicon.

According to an embodiment of the present invention, the second layer of the insulating bands is biased at a negative or zero potential.

The present invention also relates to a flat display screen of the type including a cathode with microtips and an anode comprised of at least two sets of alternate bands of phosphor elements, the anode including insulating bands according to one of the above-mentioned embodiments.

The origin of the present invention is an interpretation of the phenomena generating the above-mentioned problems in conventional screens.

The inventors consider that these problems are due, in particular, to a secondary emission phenomenon occurring at the surface of the anode.

FIG. 2 shows, schematically and in cross-sectional view, three bands of phosphor elements of an anode separated by an insulator.

For clarity, the different components shown in FIG. 2 will be referred to with the same reference numbers as in FIG. 1. Thus, three bands, respectively, 7*b*, 7*g*, and 7*r* of phosphor elements of different colors are deposited on corresponding ITO bands, respectively, 9*b*, 9*g*, and 9*r*, which are themselves deposited on a glass substrate 6 constituting the surface of the screen.

When band 9*g* is biased at 400 volts, bands 9*b* and 9*r* are not biased and so-called "primary" electrons $e_i$, emitted by the microtips (not shown) of the cathode, arrive onto the phosphor elements 7*g*. So-called "secondary" electrons $e_s$ are emitted back by the phosphor elements 7*g*. Further, a number of primary electrons arrive on the edge of the insulating bands 8 separating band 9*g* from bands 9*b* and 9*r*. Again, secondary electrons are emitted.

Any material has a secondary emission coefficient, called δ, which represents the mean number of secondary electrons which are emitted back for an incident electron arriving on this material. The prevailing energy of the statistic distribution of secondary electrons is around 30 to 50 eV, whatever the energy of the incident electrons.

The secondary emission coefficient of a material varies according to the energy of the electrons which touch its surface. In the case of microtip screens, the energy of the primary electrons is linked to the biasing potential of the anode and is, for example, around 400 eV.

When secondary emission coefficient δ is greater than 1, this means that the surface of the material emits back more electrons than it has received and tends to charge positively. Conversely, when secondary emission coefficient δ is smaller than 1, electrons are accumulated.

The fact that microtip screens are implemented by using technologies derived from those used in the making of integrated circuits has resulted in the use of silicon oxide to implement insulating bands 8. Indeed, silicon oxide is a usual material and its use is well controlled. Unfortunately, silicon oxide has a particularly high secondary emission coefficient.

FIG. 3 illustrates the characteristic of the evolution of the secondary emission coefficient of silicon oxide ($SiO_2$) according to the energy of the incident electrons in eV.

Whatever the material, this characteristic is bell-shaped, that is, coefficient δ starts to increase until it reaches a level $\delta_{max}$ for an amount of energy $U_{max}$, and then decreases to an asymptote value.

Phosphor elements generally have a coefficient $\delta_{max}$ of around 2 to 2.5 for an energy $U_{max}$ of around 500 eV.

For silicon oxide, $\delta_{max}$ is around 3 for an energy $U_{max}$ of around 400 eV. Conventional screens thus operate in the maximum secondary emission region and the primary electrons which reach the silicon oxide of bands 8 generate a high emission of secondary electrons.

The consequence of this secondary emission phenomenon on a microtip screen anode is the following.

Initially, the tracks 8 of insulating material in silicon oxide are at a zero potential. The primary electrons which arrive on the edges of the insulating tracks neighboring a biased band (for example, 9*g*) cause, by the emission of secondary electrons, a positive surface charge of the silicon oxide. As the screen operates, this positive charge area develops, since the primary electrons are more and more attracted by the surface as its positive charge increases, which causes a decrease in the brightness of biased band 7*g*. The positive charge area propagates towards non-biased neighboring tracks 9*b* and 9*r* and its potential can exceed the biasing potential of the anode bands.

Secondary electrons which are emitted back by phosphor elements 7*g* are then attracted by this positive charge area, which increases the phenomenon.

Further, the surface potential of an insulating band 8 can become such that it causes the forming of a destructive spark between the anode and the cathode.

Besides, and although the silicon oxide and the phosphor elements have a secondary emission coefficient smaller than 1 for an energy of around 30 to 50 eV which corresponds to the energy of the majority of the secondary electrons, the emission of an electron results in turn in a new emission of secondary electrons, which leads to an avalanche effect.

Indeed, some secondary electrons have enough energy, the value from 30 to 50 eV corresponding to the maximum amount of a statistic distribution.

Further, the transverse electric field between two bands of phosphor elements, respectively biased and non-biased, accelerates the secondary electrons which then have an energy considerably higher than their initial energy (of around 250 eV).

Since phosphors are relatively insulating materials (they generally have a linear resistance of around $10^8$ Ω.cm), they do not discharge completely when the ITO band which supports them is no longer biased but they remain charged to a potential, generally around 50 volts. Thus, the phosphors of a non-biased band end up being excited by the secondary electrons emitted back by the insulating tracks 8.

The phenomenon of emission of secondary electrons has a second disadvantage in microtip screens. Indeed, when electrons contact the material of layer 8, they can either generate a positive ion or desorb a neutral species (any molecule stuck at the surface of track 8), or else hit a neutral species and thus generate a positive ion. This phenomenon leads to the forming of a microplasma at the surface of track 8. The cathode microtips then attract the positive ions of the plasma and are contaminated by these positive ions.

Further, these plasmas generally radiate. This radiation appears as a bluish gleam which can be seen through the screen surface. Besides, the positive ions are likely to excite the phosphor elements of the neighboring band (not biased) by photoluminescence.

This phenomenon of secondary electron emission is a known phenomenon, especially in cathode-ray tubes where the screen surface also carries phosphors which are bombarded by an electron gun.

In the case of cathode-ray tubes, the problem due to the secondary emission phenomenon is solved by coating the phosphors with a metallization, generally a thin aluminum layer, biased at a high positive voltage. The function of this metallization is, on the one hand, to bias the phosphors, and on the other hand to drain the primary charges which were not consumed as well as the secondary charges which are then collected.

This solution is not applicable to microtip screens, for several reasons.

First, it is not desirable to coat the phosphors of a microtip screen with a metallic layer due to the relatively low energy of primary electrons. Indeed, in a cathode-ray tube, the electrons emitted by the electron gun have an energy of around 20 to 30 keV and thus cross the thin metallization layer, whereas the low energy secondary electrons (30 eV) are collected by the metallization. In a microtip screen, the energy of the primary electrons (around 400 eV) is not sufficient.

Second, in the case of a color cathode-ray tube, all phosphors are biased at a same potential by the single aluminum layer, whatever their color. Conversely, in the case of a microtip color screen, the anode is comprised of a set of alternate parallel bands biased by sets of bands of a same color. The bands of phosphor elements thus have to be insulated from one another to enable screen operation.

Based on this analysis, the present invention provides to suppress the phenomenon of secondary emission on the anode of a flat display screen.

The foregoing objects, features and advantages of the present invention will be discussed in detail in the following non-limiting description of specific embodiments of the present invention, in relation with the accompanying drawings.

DETAILED DESCRIPTION

A feature of the present invention is to select for the insulating tracks separating two bands of phosphor elements of an anode provided with sets of alternate bands of phosphor elements, a surface material among materials having a low secondary emission coefficient δ.

The material is, according to the present invention, chosen so that its secondary emission coefficient is lower than 1, at least in the energy range of the primary electrons emitted by the microtips.

The selected material should meet some conditions inherent to the operation of a flat display screen of this type. In particular, this material should meet the insulation requirements between the bands of phosphor elements of the anode, that is, it should withstand a potential difference of around 500 volts without conducting (that is, with a low leakage current).

If necessary, a metallic material which will then be deposited in a very thin layer can be chosen to have a sufficient resistance between the bands of phosphor elements. It could also be a dielectric (metal oxide), which is reduced to only exhibit metal at its surface.

According to a first embodiment (not shown), the insulating layer, generally silicon oxide, is replaced with a layer of material having a secondary emission coefficient lower than 1, at least in the energy range of the incident electrons emitted by the cathode (not shown). However, a material with sufficient resistivity will be chosen, even though it is deposited with a thickness of around 1 μm.

Figure 4:
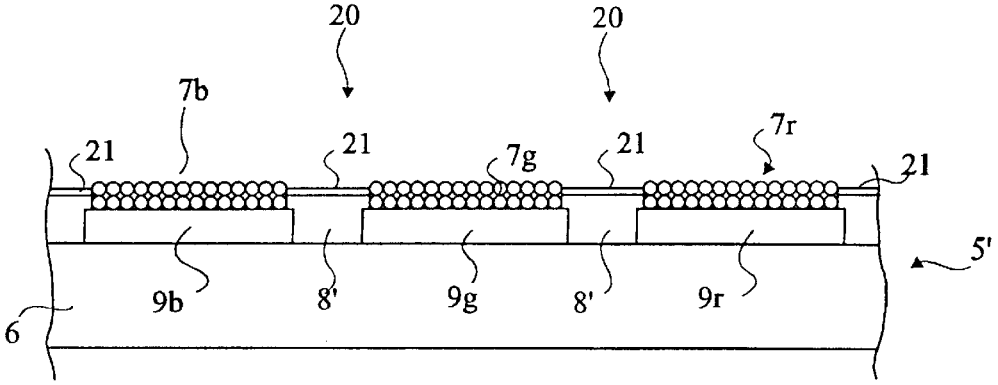
FIG. 4 shows an embodiment of a cathodoluminescence flat display screen anode according to the present invention.

FIG. 4 shows a second embodiment of the present invention. According to the present invention, the ITO bands 9 of anode 5' are separated by insulating bands 20 comprised of a first insulating layer 8' (having a thickness of a few microns, or even less), for example, silicon oxide, covered with a second very thin layer 21 (having a thickness smaller than 1 μm) of a material having a secondary emission coefficient which is lower than 1.

An advantage of this second embodiment is that the resistivity of the material is much easier to control on such a very thin layer.

In order to improve the insulation between the phosphor element bands, one may provide that the width of the second layer 21 be smaller than the width of the first layer 8' in order to leave, on either side of layer 21, an insulating space (having a thickness of about 5 to 10 μm).

Since surface material 21 of bands 20 has a secondary emission coefficient which is lower than 1, it charges negatively, as the screen operates, when the edge of surface 21 receives primary electrons from the microtips (not shown). This negative charge leads to the electrons being, conversely to what happens in conventional screens, more and more repelled by insulating bands 20.

This negative charge increases up to a charge balance point due to the positive biasing of the neighboring band of phosphor elements.

It should be noted that this charge balance is performed with the biased band, since the other band of phosphor elements, neighboring the track of secondary material, is at a much lower potential (about 50 volts).

However, such a balance depends on the resistivity of material 21 at the surface of bands 20 and is difficult to control.

As an alternative, the secondary bands 21 deposited on the silicon oxide are biased at a zero or low potential. The resistance of the secondary bands is not disturbing with respect to such a biasing. Indeed, the current which flows is very low and there are thus very little resistive losses. The voltage drop generated by the band resistance on the biasing is low.

An advantage of such an alternative is that it enables to control the negative charge level of these bands 21 and, thus, to ensure that no screen destructive effect caused by a current flowing from a non-biased band occurs.

An advantage of the present invention is that it cancels any color shift phenomenon.

Another advantage of the present invention is that it cancels the forming of microplasma between the bands of phosphor elements 7 and thus avoids the contamination of the cathode microtips (not shown).

Another advantage of the present invention is that the accumulation of negative charges between the bands of phosphor elements constitutes a barrier focusing towards the biased bands.

Four examples of materials which may be chosen to coat the surface of the first layer constitutive of bands 20 will be indicated hereafter.

According to a first example, the surface of the first layer 8' of silicon oxide ($SiO_2$) is conditioned to develop, at the surface, a very thin layer 21 of silicon (Si) of about one hundred Angströms. Although silicon has a coefficient $\delta_{max}$ of about 1.1 (FIG. 3), this $\delta_{max}$ corresponds to an energy $U_{max}$ of about 250 eV and silicon has a coefficient $\delta$ lower than 1 for the 400 eV energy of the primary electrons.

It is thus possible to choose, for layer 21, a material having a coefficient $\delta_{max}$ which is only slightly higher than 1, provided that its secondary emission coefficient $\delta$ is lower than 1 in the energy range of the primary electrons from the microtips. However, it is preferred to choose a material having a coefficient $\delta_{max}$ which is lower than 1, since this guarantees the absence of secondary emission independently from the energy of the primary electrons, that is, independently from the biasing values of the anode and the cathode.

Figure 1:
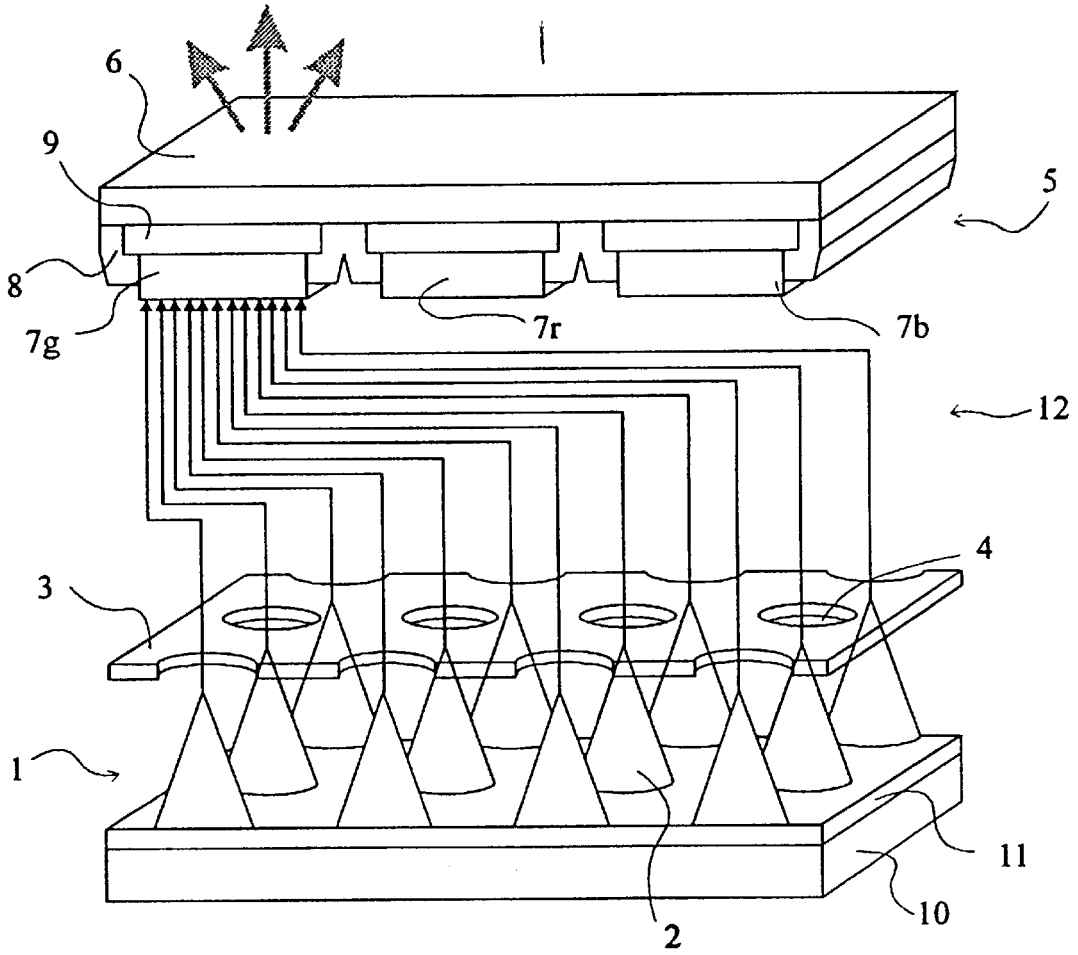
Fig 1 (PRIOR ART)
FIGS. 1 and 2, previously described, are meant to disclose the state of the art and the problem to solve.
Figure 2:
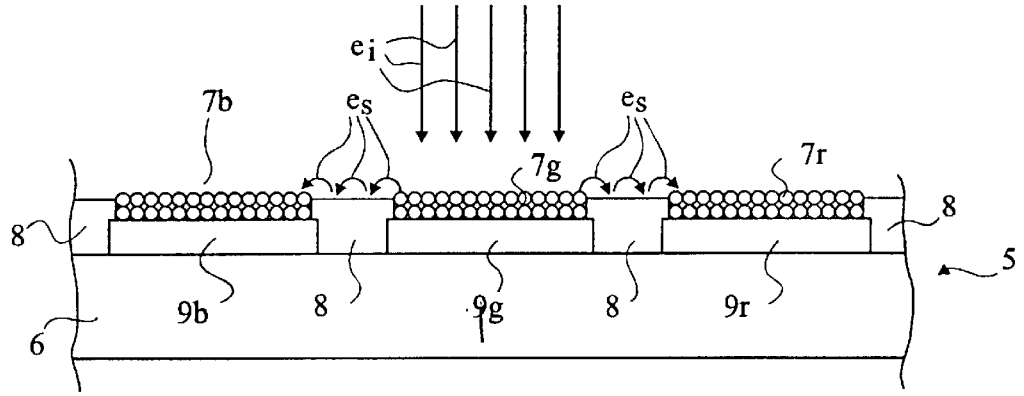
Figure 3:
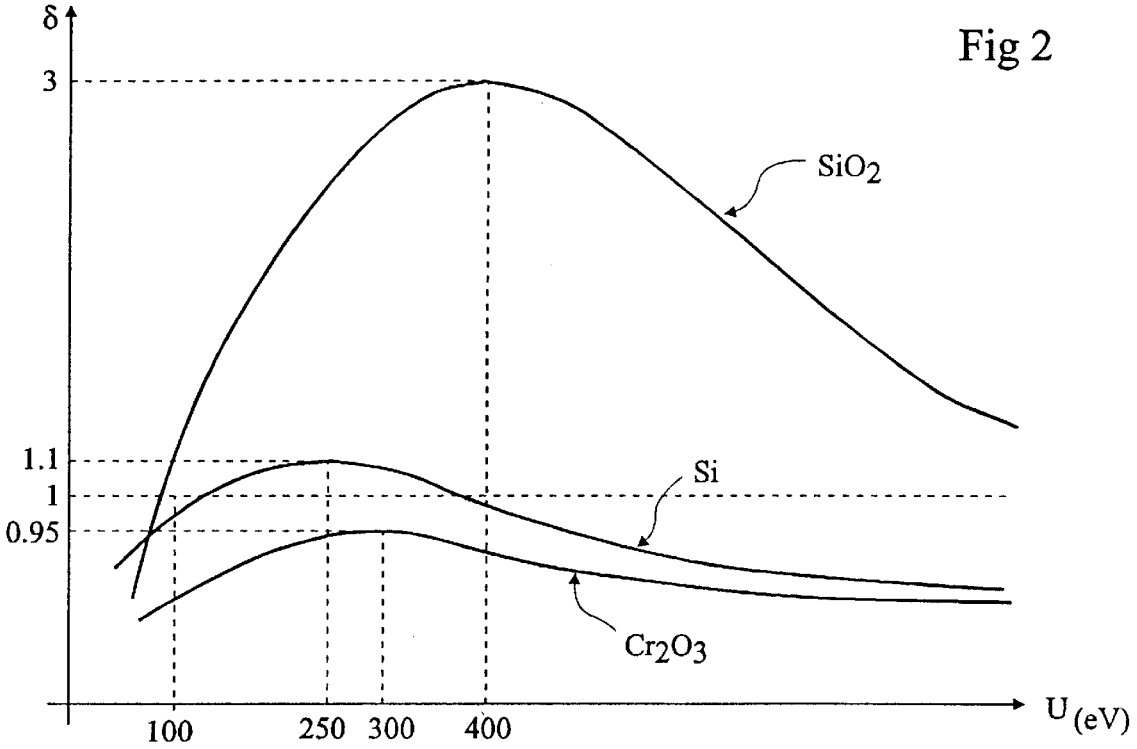
FIG. 3 shows characteristics of the secondary emission coefficient as a function of the energy of incident electrons for different materials.

According to a second example, chromium oxide ($Cr_2O_3$) is deposited by cathode sputtering on the first silicon oxide layer 8'. This deposition is, preferably, performed with a thickness of about 1000 to 2000 Angstroms for a screen with an anode/cathode voltage of about 500 volts. An intertrack resistance of about 500 MΩ is thus obtained. The maximum secondary emission coefficient $\delta_{max}$ is about 0.95 for an energy $U_{max}$ of about 300 eV (FIG. 3).

According to a third example, iron oxide ($Fe_2O_3$), having a maximum secondary emission coefficient $\delta_{max}$ of about 0.9 for an energy $U_{max}$ of about 350 eV is deposited by cathode sputtering on silicon oxide layer 8'. This deposition is performed with a thickness of about 1000 Angströms and the intertrack insulation resistance obtained is about 500 MΩ.

According to a fourth example, graphite carbon (C) having a maximum secondary emission coefficient $\delta_{max}$ of 1 for an energy $U_{max}$ of about 300 eV is deposited by cathode sputtering on the silicon oxide.

It will be noted that the implementation of the present invention is compatible with the low thicknesses (a few microns, or even less) of the layers constituting the anode and with the conventional thin layer depositing methods (in particular of the insulating bands) which are generally used for manufacturing the conventional anodes.

Of course, the present invention is likely to have various alterations, modifications, and improvements which will readily occur to those skilled in the art. In particular, the thickness of the materials with a secondary emission coefficient lower than 1 will be chosen according to the functional indications given hereabove. Similarly, other materials as those mentioned above may be used to implement the function of blocking secondary emission and the deposition processes of these materials are within the abilities of those skilled in the art.

Further, the present invention not only applies to a color screen, but also to a monochrome screen, the anode of which is comprised of two sets of alternate parallel bands of phosphor elements of a same color, alternately biased.

We claim:

1. A flat display screen anode including at least two sets of alternate parallel bands of anode conductors coated with phosphor elements to be excited by primary electrons wherein said alternate parallel bands are separated from one another by insulating bands, each said insulating band comprising a first thin layer in an insulating material covered with a second very thin layer in a material having a secondary emission coefficient which is lower than one, wherein the second layer has a width smaller than that of the first layer to leave, on either side of the second layer, an insulating space.

2. The anode according to claim 1, wherein the material constitutive of the second layer is chosen to have sufficient resistivity to withstand a determined voltage difference between two neighboring bands of phosphor elements.

3. The anode according to claim 1, wherein the second layer is in a conductive material, the thickness of the second layer being chosen to have sufficient resistance to withstand a determined voltage difference between two neighboring bands of phosphor elements.

4. The anode according to claim 1, wherein the material of said second layer having a secondary emission coefficient lower than unity is selected among chromium oxide ($Cr_2O_3$) and iron oxide ($Fe_2O_3$).

5. The anode according to claim 1, wherein the material constitutive of the second layer is graphite carbon (C).

6. The anode according to claim 1, wherein the insulating bands are in silicon oxide ($SiO_2$), wherein a surface of said second very thin layer is made of silicon (Si).

7. The anode according to claim 1, wherein the second layer of the insulating bands is biased at a negative or zero potential.

8. A flat display screen, comprising: a cathode with microtips and an anode having at least two sets of alternate bands of phosphor elements, wherein the anode includes insulating bands which separate said alternate parallel bands from one another, wherein each insulating band has a first thin layer of an insulating material covered with a second very thin layer of a material having a secondary emission coefficient which is lower than or equal to unity, and wherein said second very thin layer has a width smaller than that of said first thin layer.

* * * * *